US011399688B1

(12) United States Patent
Ward, Sr. et al.

(10) Patent No.: US 11,399,688 B1
(45) Date of Patent: Aug. 2, 2022

(54) GROUT LINE SQUEEGEE TOOL

(71) Applicants: Winfred Lynn Ward, Sr., Fort Myers, FL (US); Ozella Ward, Fort Myers, FL (US)

(72) Inventors: Winfred Lynn Ward, Sr., Fort Myers, FL (US); Ozella Ward, Fort Myers, FL (US)

( * ) Notice: Subject to any disclaimer, the term of this patent is extended or adjusted under 35 U.S.C. 154(b) by 0 days.

(21) Appl. No.: 17/553,734

(22) Filed: Dec. 16, 2021

Related U.S. Application Data

(60) Provisional application No. 63/128,043, filed on Dec. 19, 2020.

(51) Int. Cl.

| | |
|---|---|
| ***A47L 13/12*** | (2006.01) |
| ***A47L 13/11*** | (2006.01) |
| ***E04F 21/165*** | (2006.01) |
| ***E04F 21/00*** | (2006.01) |
| ***A47L 13/16*** | (2006.01) |

(52) U.S. Cl.
CPC ..... *A47L 13/12* (2013.01); *A47L 13/11* (2013.01); *A47L 13/16* (2013.01); *E04F 21/0084* (2013.01); *E04F 21/165* (2013.01)

(58) Field of Classification Search
CPC ..... A47L 13/12; A47L 13/11; A47L 13/16; E04F 21/165; E04F 21/1652; E04F 21/0084
USPC ..... 15/105, 105.5, 121, 117
See application file for complete search history.

(56) References Cited

U.S. PATENT DOCUMENTS

| | | | | |
|---|---|---|---|---|
| 1,195,297 | A * | 8/1916 | Vlchek | E04F 21/165 15/104.012 |
| 4,064,588 | A | 12/1977 | Cooper | |
| 4,097,951 | A | 7/1978 | Hurtt | |
| 4,230,356 | A | 10/1980 | O'Connor | |
| 4,299,513 | A | 11/1981 | Stegmeier | |
| 4,399,170 | A | 8/1983 | Janssen | |
| 4,698,870 | A | 10/1987 | Clark | |
| 5,413,258 | A | 5/1995 | Kartler | |
| 5,607,256 | A | 3/1997 | McCleary | |
| 5,622,728 | A | 4/1997 | Kartler | |
| 5,807,022 | A | 9/1998 | McCleary | |
| 5,809,604 | A * | 9/1998 | Olstyn | A46B 5/02 D4/118 |
| 6,023,811 | A | 2/2000 | Ciarrocchi | |
| 6,092,255 | A * | 7/2000 | Kim | A47L 1/06 15/245 |

(Continued)

FOREIGN PATENT DOCUMENTS

DE 29623797 U1 * 2/2000 ..... E01H 1/12

*Primary Examiner* — Laura C Guidotti
(74) *Attorney, Agent, or Firm* — Quickpatents, LLC; Kevin Prince

(57) ABSTRACT

A tool for cleaning a tile bonding compound from between and on a plurality of adjacent tiles includes an elongated handle and a tool head fixed with the handle. The tool head is comprised of a first tool and a second tool. The first tool includes a foam scrubber and a seam scrubber or wiper. The second tool includes at least one arcuate elastomeric wiper and a seam wiper. Both the foam scrubber and elastomeric wiper are adapted for scrubbing the tile bonding compound from a front face of the adjacent tiles, while the seam scrubber and seam wiper are adapted for fitting between two of the adjacent tiles to scrub the tile bonding compound from between the tiles.

14 Claims, 3 Drawing Sheets

(56) References Cited

U.S. PATENT DOCUMENTS

| | | | | |
|---|---|---|---|---|
| 6,219,878 | B1 | 4/2001 | Dewberry | |
| 6,240,591 | B1 | 6/2001 | Maxted | |
| 6,439,983 | B1 | 8/2002 | McCoy | |
| 6,546,589 | B1 | 4/2003 | Job | |
| 6,578,229 | B1 | 6/2003 | Dziallas | |
| 6,776,595 | B2 | 8/2004 | Dewberry | |
| 7,210,188 | B1 * | 5/2007 | Kirby | A47L 13/16 15/244.4 |
| 7,406,739 | B2 | 8/2008 | Guest | |
| 7,484,263 | B2 | 2/2009 | Rice | |
| 7,644,467 | B2 | 1/2010 | Kleinhammer | |
| 8,011,918 | B2 | 9/2011 | Erickson | |
| 8,307,490 | B2 | 11/2012 | Gringer | |
| 8,813,294 | B2 * | 8/2014 | Frigo, Jr. | B32B 3/08 15/244.4 |
| 9,447,591 | B2 | 9/2016 | McKay | |
| D773,766 | S * | 12/2016 | Smith | D32/41 |
| 10,077,030 | B2 * | 9/2018 | Paro | A47L 13/11 |
| 10,947,744 | B1 * | 3/2021 | Barsamian | E04F 21/16 |
| 2003/0192142 | A1 | 10/2003 | Veith | |
| 2004/0250364 | A1 | 12/2004 | Kairys | |
| 2007/0044262 | A1 | 3/2007 | Wakat | |
| 2007/0169298 | A1 | 7/2007 | Marshall | |
| 2008/0098552 | A1 | 5/2008 | Kleinhammer | |
| 2008/0229535 | A1 | 9/2008 | Walter | |
| 2009/0047055 | A1 | 2/2009 | Dyer | |
| 2010/0108235 | A1 | 5/2010 | Parmley | |
| 2013/0125503 | A1 | 5/2013 | Hilburn | |
| 2014/0352718 | A1 | 12/2014 | Lionheart | |
| 2016/0090747 | A1 | 3/2016 | Harper | |
| 2016/0222678 | A1 | 8/2016 | Windischman | |
| 2018/0103818 | A1 | 4/2018 | Mitchell | |
| 2018/0304866 | A1 * | 10/2018 | Verbakel | A47L 13/16 |
| 2020/0056078 | A1 | 2/2020 | Jurcevic | |
| 2020/0080322 | A1 | 3/2020 | Palm | |

* cited by examiner

GROUT LINE SQUEEGEE TOOL

CROSS-REFERENCE TO RELATED APPLICATIONS

This application claims the benefit of U.S. Provisional Patent Application 63/128,043, filed on Dec. 19, 2020, and is incorporated herein by reference.

STATEMENT REGARDING FEDERALLY SPONSORED RESEARCH AND DEVELOPMENT

Not Applicable.

FIELD OF THE INVENTION

This invention relates to installation of tile, and more particularly to a tool for facilitating cleaning a tile bonding compound off of the tile.

BACKGROUND

A significant problem that construction workers face when laying tile is cleaning a tile bonding compound, such as grout or adhesive, off of the tile once they are in place. Traditional tools typically aid in wiping the tile bonding compound off a front face of the tiles only, leading to excess tile bonding compound between tiles. Other separate tools exist to remove excess tile bonding compound between the tiles, but often the tool just moves the excess tile bonding compound back onto the face of the adjacent tiles. Also, different types of tools are required to accomplish the same objective with different kinds of tile bonding compound, which forces a person laying tile to have multiple tools on hand, further complicating the process.

Therefore, there is a need for a device that can remove excess tile bonding compound from the face of the tiles as well as the space between tiles simultaneously. The needed device would also include multiple tools to keep all necessary tools on hand at all times. The present invention accomplishes these objectives.

SUMMARY OF THE INVENTION

The present device is a tool for cleaning a tile bonding compound from between and on a plurality of adjacent tiles. The tool is comprised of an elongated handle having a proximal end and a distal end. The handle can be comprised of any rigid, durable material, but preferably is comprised of wood or a plastic material.

A tool head is fixed with the distal end of the handle and is comprised of a first tool on a first side of the tool head, and a second tool on an opposing second side of the tool head. The first tool includes an arcuate foam scrubber which has two opposing ends, each adapted for scrubbing the tile bonding compound from a front face of one of the adjacent tiles and each end is projected laterally mutually away from the second end of the elongated handle. A foam seam scrubber projects upwardly from the tool head orthogonal to the arcuate foam scrubber and handle, and is adapted for fitting between two of the adjacent tiles to scrub the tile bonding compound from between the tiles.

The second tool includes at least one arcuate elastomeric wiper, which has two opposing ends adapted for wiping the tile bonding compound from the front face of one of the adjacent tiles, and a seam wiper which projects upwardly from the tool head orthogonal to the arcuate elastomeric wiper and is adapted for fitting between two of the adjacent tiles to wipe the tile bonding compound out from between the tiles. A preferred embodiment includes exactly three of the arcuate elastomeric wipers mutually aligned in parallel.

The present invention allows removal of excess tile bonding compound from the face of the tiles as well as from the space between tiles simultaneously. The invention also includes multiple tools to keep all necessary tools on hand at all times. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
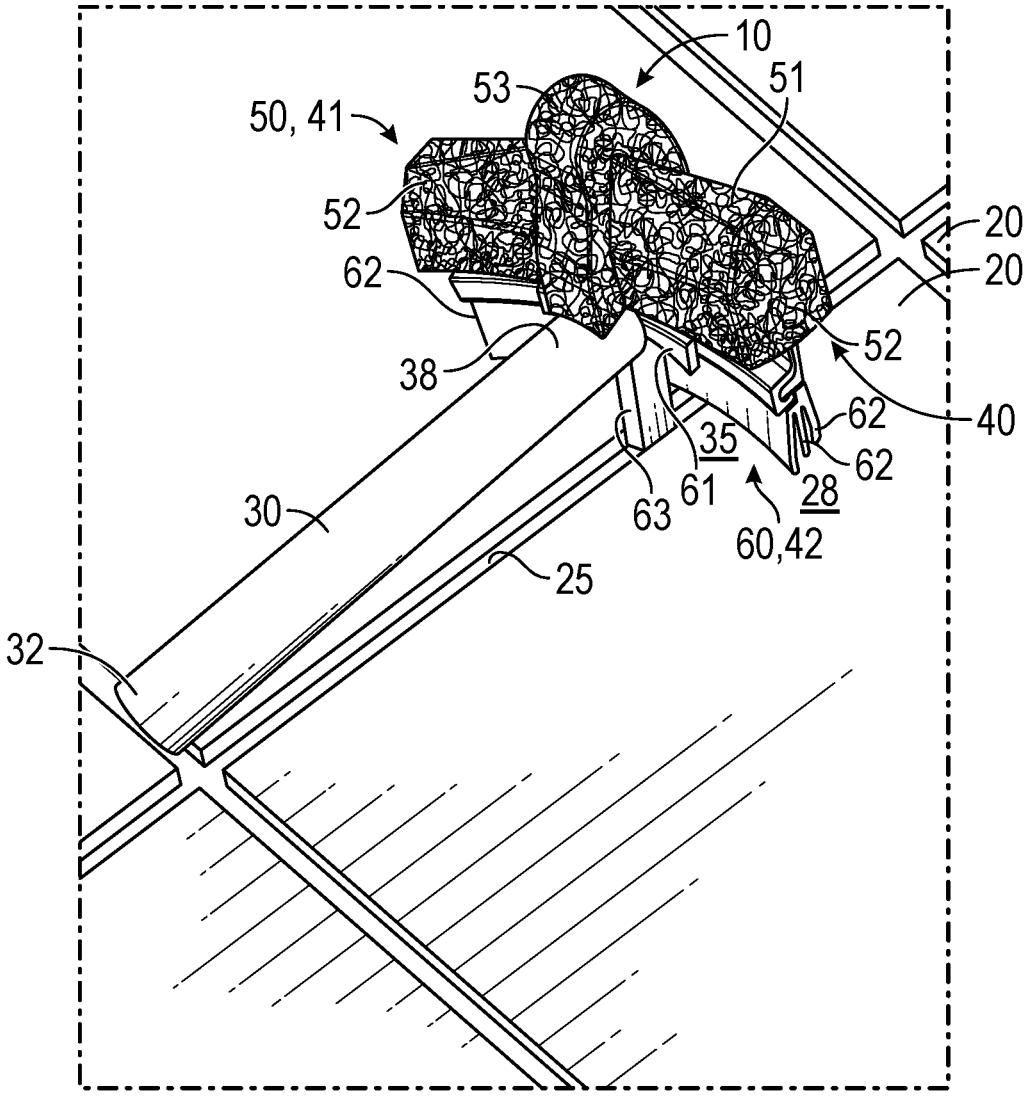
FIG. 1 is a top perspective view of the claimed invention in use.
Figure 2:
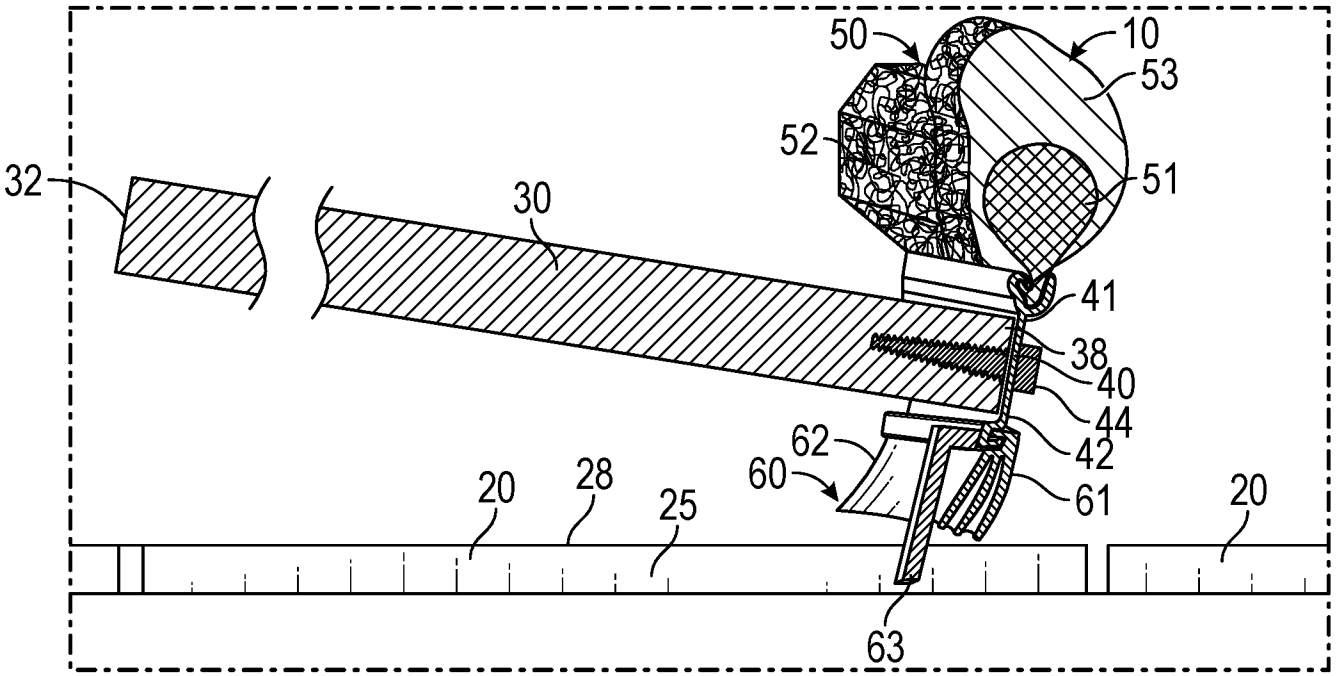
FIG. 2 is a cross-sectional view of the claimed invention in use.

FIGS. 1 and 2 illustrate a tool 10 for cleaning a tile bonding compound 25 from between and on a plurality of adjacent tiles 20. The tile bonding compound 25 is adhesive, grout, or like compound applied during tile installation, typically by a construction worker or home owner.

The tool 10 includes an elongated handle 30 having a proximal end 32 and a distal end 38. The handle 30 can be made from any rigid, durable material, but preferably is comprised of metal, wood or a plastic material. A tool head 40 is fixed with the distal end 38 of the handle 30 and is comprised of a first tool 50 on a first side 41 of the tool head 40, and a second tool 60 on an opposing second side 42 of the tool head 40.

The first tool 50 includes an arcuate foam scrubber 51 which has two opposing ends 52, and is adapted for scrubbing the tile bonding compound 25 from a front face 28 of one of the adjacent tiles 20. Each end 52 projects laterally mutually away from the distal end 38 of the elongated handle 30. In one embodiment, a foam seam scrubber 53 projects upwardly from the tool head 40 orthogonal to the arcuate foam scrubber 51 and the handle 30. The foam seam scrubber 53 is adapted for fitting between two of the adjacent tiles 30 to scrub away the tile bonding compound 25 from between the tiles 20.

The second tool 60 includes at least one arcuate elastomeric wiper 61, which has two opposing ends 62 and is adapted for wiping the tile bonding compound 25 from the front face 28 of one of the adjacent tiles 20. The second tool 60 further includes a first seam wiper 63 which projects upwardly from the tool head 40 orthogonal to the arcuate elastomeric wiper 61 and the handle 30. The seam wiper 63 is adapted for fitting between two of the adjacent tiles 20 to wipe the tile bonding compound 25 out from between the tiles 20. A preferred embodiment includes exactly three of the arcuate elastomeric wipers 61 mutually aligned in parallel.

Figure 3:
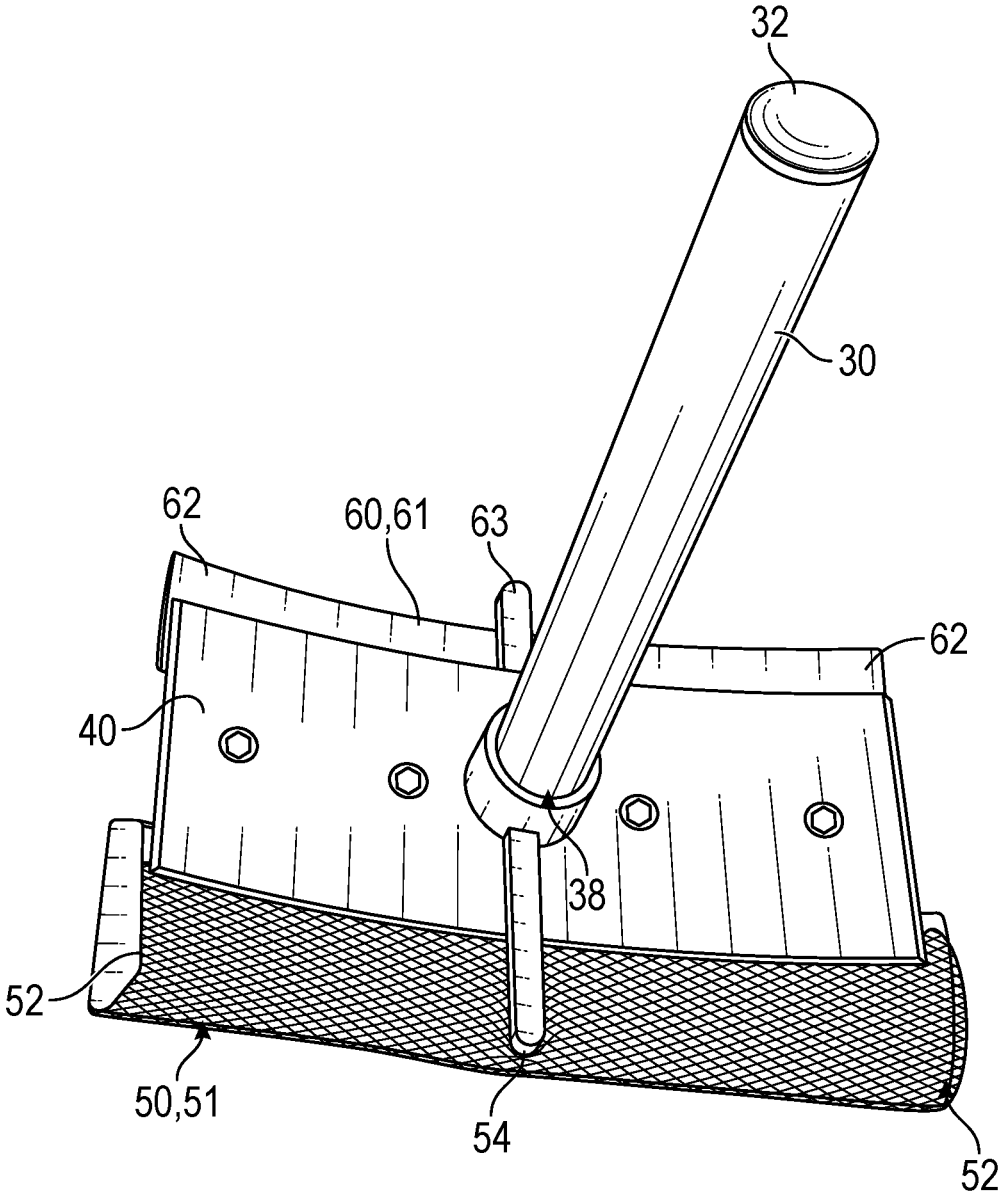
FIG. 3 is a bottom perspective view of an alternate embodiment of the invention.

In some embodiments, the foam seam scrubber 53 is replaced with a second seam wiper 54 (FIG. 3), preferably having a width different from a width of the first seam wiper 63, whereby either the first seam wiper 63 or the second seam wiper 54 is used depending upon a distance between the tiles 20.

While a particular form of the invention has been illustrated and described, it will be apparent that various modifications can be made without departing from the spirit and scope of the invention. For example, the elongated handle 30 is depicted as cylindrical in shape, but the handle 30 can also be molded to be indented to fit a person's hand, be curved, or have any number of shapes. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A tool for cleaning a tile bonding compound from between and on a plurality of adjacent tiles, the tool comprising:

an elongated handle having a proximal end and a distal end;

a tool head fixed with the distal end of the handle and comprising a first tool on a first side of the tool head, and a second tool on an opposing second side of the tool head;

the first tool including an arcuate foam scrubber having two opposing ends each adapted for scrubbing the tile bonding compound from a front face of one of the adjacent tiles, each end projecting laterally mutually away from the second end of the elongated handle, a foam seam scrubber projecting upwardly from the tool head orthogonal to the arcuate foam scrubber and adapted for fitting between two of the adjacent tiles to scrub the tile bonding compound from between the tiles;

the second tool including at least one arcuate elastomeric wiper having two opposing ends adapted for wiping the tile bonding compound from a front face of one of the adjacent tiles, a seam wiper projecting upwardly from the tool head orthogonal to the arcuate elastomeric wiper and adapted for fitting between two of the adjacent tiles to wipe the tile bonding compound out from between the tiles.

2. The tool of claim 1 wherein the elastomeric wiper and the arcuate foam scrubber are mutually fixed.

3. The tool of claim 1 wherein the at least one arcuate elastomeric wiper includes exactly three of the arcuate elastomeric wipers mutually aligned in parallel.

4. The tool of claim 1 wherein the handle includes a wood material.

5. The tool of claim 1 wherein the handle includes a plastic material.

6. The tool of claim 1 wherein the handle includes a metallic material.

7. A tool for cleaning a tile bonding compound from between and on a plurality of adjacent tiles, the tool comprising:

an elongated handle having a proximal end and a distal end;

a tool head fixed with the distal end of the handle and comprising a first tool on a first side of the tool head, and a second tool on an opposing second side of the tool head;

the first tool including an arcuate foam scrubber having two opposing ends each adapted for scrubbing the tile bonding compound from a front face of one of the adjacent tiles, each end projecting laterally mutually away from the second end of the elongated handle, a first seam wiper projecting upwardly from the tool head orthogonal to the arcuate foam scrubber and adapted for fitting between two of the adjacent tiles to wipe the tile bonding compound from between the tiles;

the second tool including at least one arcuate elastomeric wiper having two opposing ends adapted for wiping the tile bonding compound from a front face of one of the adjacent tiles, a second seam wiper projecting upwardly from the tool head orthogonal to the arcuate elastomeric wiper and adapted for fitting between two of the adjacent tiles to wipe the tile bonding compound out from between the tiles.

8. The tool of claim 7 wherein the elastomeric wiper and the arcuate foam scrubber are mutually fixed.

9. The tool of claim 7 wherein the at least one arcuate elastomeric wiper includes exactly three of the arcuate elastomeric wipers mutually aligned in parallel.

10. The tool of claim 7 wherein the handle includes a wood material.

11. The tool of claim 7 wherein the handle includes a plastic material.

12. The tool of claim 7 wherein the handle includes a metallic material.

13. The tool of claim 7 wherein a width of the first seam wiper is different than a width of the second seam wiper, either the first seam wiper or the second seam wiper is used depending upon a distance between the tiles.

14. A tool for cleaning a tile bonding compound from between and on a plurality of adjacent tiles, the tool comprising:

an elongated handle having a proximal end and a distal end;

a tool head fixed with the distal end of the handle and comprising a first tool on a first side of the tool head, and a second tool on an opposing second side of the tool head;

the first tool including an arcuate foam scrubber having two opposing ends each adapted for scrubbing the tile bonding compound from a front face of one of the adjacent tiles, each end projecting laterally mutually away from the second end of the elongated handle, a first seam wiper projecting upwardly from the tool head orthogonal to the arcuate foam scrubber and adapted for fitting between two of the adjacent tiles to wipe the tile bonding compound from between the tiles;

the second tool including three arcuate elastomeric wipers each mutually aligned in parallel and having two opposing ends adapted for wiping the tile bonding compound from a front face of one of the adjacent tiles, a second seam wiper projecting upwardly from the tool head orthogonal to the arcuate elastomeric wiper and adapted for fitting between two of the adjacent tiles to wipe the tile bonding compound out from between the tiles;

wherein the elastomeric wiper and the arcuate foam scrubber are mutually fixed.

* * * * *